United States Patent [19]

Damiano et al.

[11] Patent Number: 4,939,846

[45] Date of Patent: Jul. 10, 1990

[54] ADJUSTABLE GUIDE ASSEMBLY FOR STONE MASONS AND METHOD OF USE THEREOF

[76] Inventors: Louis Damiano, 53 Ashburton St., Providence, R.I. 02904; Anthony G. Caputo, 7 Crow Point Rd., Lincoln, R.I. 02865

[21] Appl. No.: 305,271

[22] Filed: Feb. 2, 1989

[51] Int. Cl.[5] ..... B43L 13/00

[52] U.S. Cl. ..... 33/404; 33/365

[58] Field of Search ..... 33/404, 406, 407, 410, 33/578, 370, 371, 375, 365

[56] References Cited

U.S. PATENT DOCUMENTS

| | | | |
|---|---|---|---|
| 555,614 | 3/1896 | Mowrer . | |
| 709,944 | 9/1902 | Vogelbach et al. . | |
| 715,946 | 12/1902 | Bennett | 33/380 X |
| 1,145,694 | 7/1915 | McKnight . | |
| 1,781,997 | 11/1930 | Berezowski . | |
| 2,915,273 | 12/1959 | Gavrun, Sr. . | |
| 2,915,829 | 12/1959 | Baxter | 33/375 |
| 3,101,184 | 8/1963 | Allen et al. | 33/404 X |
| 3,206,854 | 9/1965 | Andrews | 33/406 |
| 3,934,316 | 1/1976 | Driscoll . | |
| 4,501,057 | 2/1985 | Palomera . | |
| 4,683,633 | 8/1987 | Loris . | |

*Primary Examiner*—Harry N. Haroian
*Attorney, Agent, or Firm*—Salter & Michaelson

[57] ABSTRACT

An adjustable guide assembly for use by a stone mason in constructing a brick wall so that the bricks thereof are uniformly spaced forwardly from a preexisting subwall. The guide assembly includes an elongated guide member having a longitudinally extending substantially straight guide face thereon, an elongated spacer element and a clamp for securing the spacer element to the guide member so that it extends outwardly from the guide face by a predetermined gauge distance. After an initial or bottom row of bricks has been laid so that the front surfaces of the bricks therein are spaced forwardly from a subwall by the gauge distance, the guide assembly can be utilized by positioning it so that the guide member is in a substantially vertical disposition with the guide face in engagement with the front surfaces of the bricks in the bottom row and so that the terminal end of the spacer element is in engagement with subwall. The front surfaces of the bricks in one or more additional rows of bricks can then be aligned with the guide face on the guide member to assure that the additional rows of bricks are uniformly spaced forwardly from the subwall.

11 Claims, 1 Drawing Sheet

ADJUSTABLE GUIDE ASSEMBLY FOR STONE MASONS AND METHOD OF USE THEREOF

BACKGROUND AND SUMMARY OF THE INVENTION

The instant invention relates to masonry tools, and more particularly to an adjustable guide assembly and method for constructing a brick wall.

It is generally common practice in the construction industry to construct the brick walls of buildings so that they are spaced forwardly from preexisting subwalls made of plywood or other sheet materials. However, since the subwalls of many buildings are often not perfectly vertical or plumb, it is generally necessary to intentionally construct the outer brick walls of buildings so that they are substantially parallel to the subwalls therebehind rather than perfectly plumb in order to maintain the brick walls in substantially uniformly spaced relation to their respective subwalls. In this connection, it will be apparent that if a brick wall is constructed in front of a subwall so that it is perfectly plumb rather than uniformly spaced forwardly from the subwall, it is possible for the two walls to converge in their upward extents until they actually meet, or for the two walls to diverge by an excessive amount. Accordingly, it has been found that it is generally preferable to construct a brick wall so that it is substantially uniformly spaced forwardly from a subwall therebehind rather than perfectly plumb. However, it has been further found that while it is generally a relatively simple matter to construct a brick wall so that it is substantially vertical or plumb utilizing a plumb line or a carpenter's level, it is generally more difficult to construct a brick wall so that it is substantially uniformly spaced forwardly from a subwall therebehind.

The instant invention provides an effective guide assembly and method for constructing a brick wall in substantially uniformly forwardly spaced relation to a subwall therebehind. More specifically, the instant invention provides an effective adjustable guide assembly which is operative for constructing a brick wall so that the front surfaces of the bricks therein are substantially uniformly spaced forwardly from a substantially vertical subwall by a predetermined gauge distance. The adjustable guide assembly of the subject invention comprises an elongated guide member having an elongated substantially straight longitudinally extending guide face thereon, and a gauge member including a spacer portion and a clamp portion for adjustably securing the spacer portion to the guide member so that the terminal end of the spacer portion is adjustably spaced outwardly from the guide face by the predetermined gauge distance. The guide member preferably comprises a carpenter's level having an aperture adjacent one end thereof and the clamp portion preferably comprises a C-clamp which is secured in clamping engagement in the aperture in the carpenter's level. The clamp portion preferably further comprises an internally threaded tubular sleeve which is secured to the C-clamp so that it is positioned in substantially parallel relation to the main clamping axis thereof. The spacer portion is preferably threaded and received in threaded engagement in the tubular sleeve on the C-clamp so that the distance by which the terminal end of the spacer portion is spaced outwardly from the carpenter's level is adjustable by rotating the threaded spacer portion in the tubular sleeve.

For use of the adjustable guide assembly of the subject invention to construct a brick wall in accordance with the method of the subject invention, a substantially horizontal bottom row of bricks is first constructed so that the front surfaces of the bricks therein are spaced forwardly from the subwall by a predetermind gauge distance. The guide assembly is then adjusted so that the terminal end of the spacer portion is spaced outwardly from the guide face of the guide member by the same gauge distance. The guide assembly can then be utilized as a guide for laying the bricks in one or more additional rows of bricks so that the front surfaces thereof are uniformly spaced forwardly from the subwall. Specifically, by positioning the guide member in a substantially vertical disposition with the guide face thereof in engagement with the bottom row of bricks and with the terminal end of the spacer portion in engagement with the subwall, the guide face can be utilized as a guide for positioning the front surfaces of the bricks in one or more additional rows of bricks laid on the bottom row.

Accordingly, it is a primary object of the instant invention to provide an effective adjustable guide assembly for use in constructing a brick wall so it is substantially uniformly spaced forwardly from a subwall.

Another object of the instant invention is to provide an adjustable guide assembly including an elongated carpenter's level having a substantially straight guide face thereon, a spacer portion, and a clamp for securing the spacer portion to the carpenter's level so that the terminal end of the spacer portion is adjustably positionable in outwardly spaced relation to the guide face.

An even further object of the instant invention is to provide an effective method of constructing a brick wall so that it is substantially uniformly spaced forwardly from a subwall.

Other objects, features and advantages of the invention shall become apparent as the description thereof proceeds when considered in connection with the accompanying illustrative drawings.

DESCRIPTION OF THE DRAWING

In the drawings which illustrate the best mode presently contemplated for carrying out the present invention.

DESCRIPTION OF THE INVENTION

Figure 1:
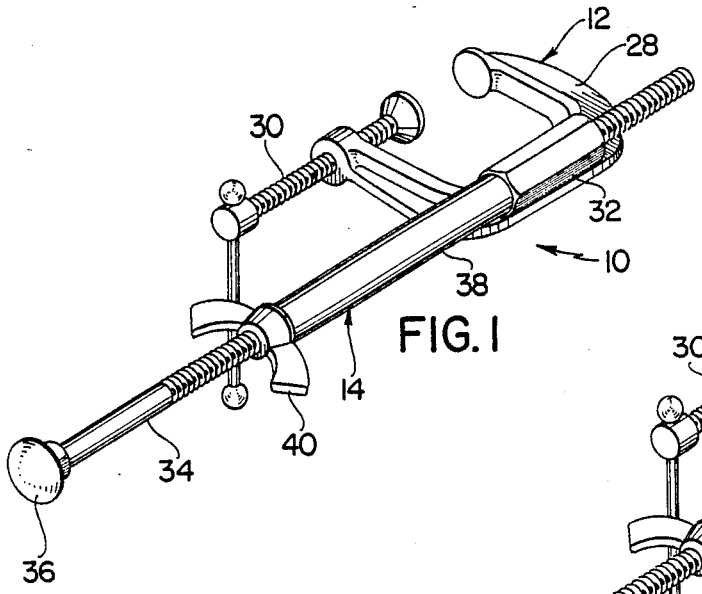
FIG. 1 is a perspective view of the gauge member of the adjustable guide assembly of the subject invention.

Referring now to the drawing, the gauge member of the guide assembly of the subject invention is illustrated in FIGS. 1 through 4 and generally indicated at 10. The gauge member 10 comprises a clamp portion generally indicated at 12 and a spacer portion generally indicated at 14, and it is operative in combination with a guide member generally indicated at 16 to provide an adjustable guide assembly generally indicated at 18 which can be utilized for constructing a brick wall of the type generally indicated at 20 in FIG. 4. More specifically, the guide assembly 18 is operative for constructing a brick wall 20 comprising a first or bottom row of bricks 22 and at least one additional row of bricks 24 so that bottom row 22 and the additional rows 24 are substantially uniformly spaced forwardly in front of a subwall 26.

The clamp portion 12 includes a frame 28 of conventional configuration, a threaded clamping element 30 and an internally threaded tubular sleeve 32. The clamping element 30 is received in threaded engagement in one end of the frame 28 so that the clamping element 30 and the frame 28 cooperate to define a conventional C-clamp type structure. The tubular sleeve 32 is welded to the frame 28 so that it is positioned in substantially parallel relation to the clamping element 30.

The spacer portion 14 comprises an elongated threaded bolt 34 having a terminal end 36, a protective tubular sleeve 38, and a wing nut 40. The wing nut 40 is received in threaded engagement on the bolt 34 and the bolt 34 is received in threaded engagement in the threaded sleeve 32 so that the bolt 34 is positioned in substantially parallel relation to the clamping element 30. The tubular sleeve 38 is received on the bolt 34 between the wing nut 40 and the sleeve 32. Accordingly, the longitudinal position of the bolt 34 relative to the clamp portion 12 can be adjusted by adjusting the position of the bolt 34 in the sleeve 32, and the bolt 34 can be locked in position relative to the frame 28 by tightening the wing nut 40 against the sleeve 38. The sleeve 38 provides a protective covering for the bolt 34 in order to prevent the threads thereof from contacting mortar or other materials utilized in constructing brick walls.

The guide member 16 preferably comprises a conventional substantially straight carpenter's level having a plurality of leveling indicators 42 thereon and an aperture 44 which extends through the guide member 16 adjacent one end thereof for hanging the guide member 16 from a nail or the like. The guide member 16 includes a substantially flat longitudinally extending guide face 46 which extends along the length thereof as illustrated. Further, it will be understood that while the guide member 16 preferably comprises a carpenter's level, the use of other substantially straight elongated members having substantially straight guide faces thereon in place of the guide member 16 is contemplated.

Figure 2:
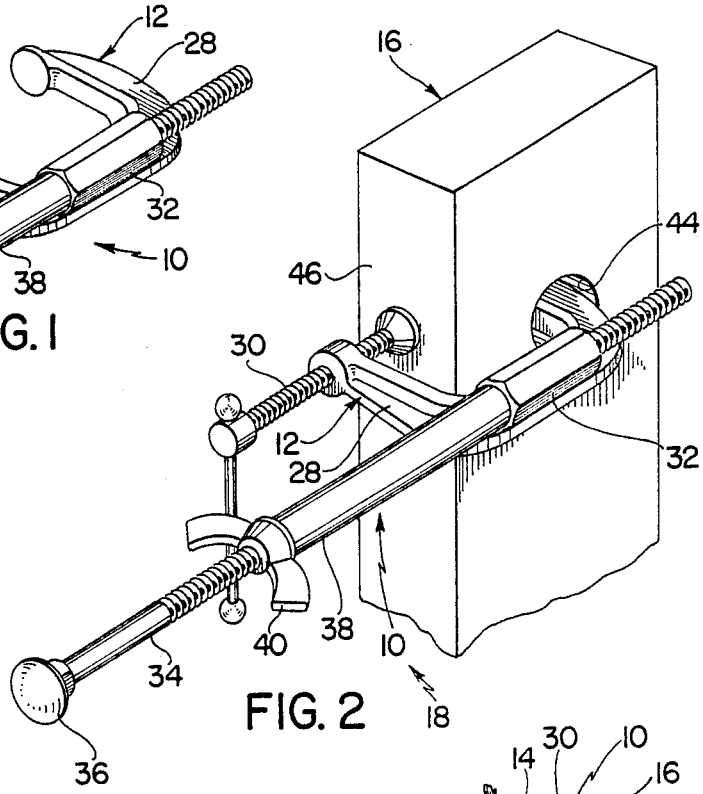
FIG. 2 is a fragmentary perspective view of the adjustable guide assembly of the subject invention.
Figure 3:
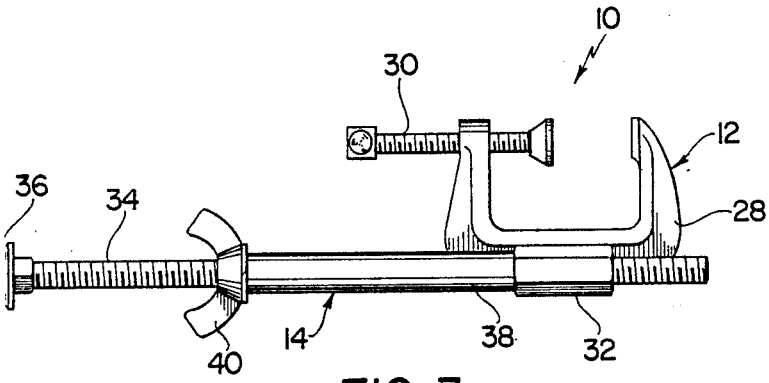
FIG. 3 is a top plan view of the gauge member.
Figure 4:
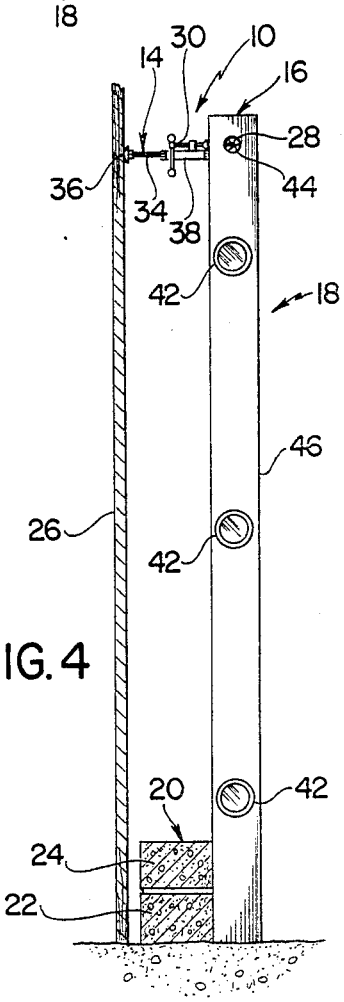
FIG. 4 is a side elevational view illustrating the use of the guide assembly.

The gauge member 10 is assembled with the guide member 16 in the manner illustrated in FIGS. 2 and 4 so that one end of the clamp portion 12 is received in the aperture 44 and so that the clamping element 30 is in clamping engagement with the guide face 46. When the gauge member 10 is secured to the guide member 16 in this manner, the spacer portion 14 extends outwardly in substantially perpendicular relation from the guide face 46. Further, by adjusting the position of the bolt 34 in the sleeve 32, the distance by which the terminal end 36 is spaced outwardly from the guide face 46 can be adjusted.

For use of the adjustable guide assembly 18 to construct a wall such as the wall 20 in accordance with the method of the subject invention, the bottom or first row of bricks 22 is laid so that the forwardly facing surfaces of the bricks thereof (the surfaces which face away from the subwall 26) are spaced outwardly from the subwall 26 by a predetermined gauge distance. In this connection, in most applications, the first row of bricks 22 is spaced forwardly from the subwall 26 by approximately one inch, although the precise amount by which the bricks in the first row 22 are spaced from the subwall 26 may vary depending on the particular application. In any event, once the first row of bricks 22 has been laid, the gauge portion 14 is adjusted so that the terminal end 36 is spaced outwardly from the guide face 46 by the gauge distance, i.e. a distance which is equal to the distance from the forwardly facing surface of the subwall 26 to the forwardly facing surfaces of the bricks in the first or bottom row 22. The guide assembly 18 can then be utilized as a guide for aligning the front surfaces of the bricks in one or more additional rows of bricks 24 in the manner illustrated in FIG. 4. Specifically, the guide assembly 18 can be utilized as a guide by positioning the guide member 16 in a substantially vertical disposition with the guide face 46 thereof in engagement with the front surface of the bottom row of bricks 22 and with the terminal end 36 is in engagement with the forwardly facing surface of the subwall 26. When the guide assembly 18 is positioned in this manner, the guide face 46 can be utilized as a guide for aligning the front surfaces of the bricks in one or more additional rows of bricks 24. Accordingly, when the wall 20 is constructed in this manner, the forwardly facing surfaces of all of the bricks in the wall 20 are substantially uniformly spaced forwardly from the subwall 26 by the gauge distance. Further, the brick wall 20 is maintained in substantially uniformly spaced relation to the subwall 26 regardless of whether or not the subwall 26 is perfectly verical or plumb.

It is seen therefore that the instant invention provides an effective guide assembly and method for constructing a brick wall so that it is substantially uniformly spaced forwardly from a subwall. Specifically, the guide assembly 18 can be effectively utilized for laying one or more additional rows of bricks 24 in the manner illustrated in FIG. 4 so that the forwardly facing surfaces of the bricks in the additional rows 24 are uniformly spaced forwardly from a subwall 26. As a result, the apparatus and method of the instant invention represent significant advancements in the art relating to construction tools and techninques.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. An adjustable guide assembly for use in constructing a brick wall of a type including a plurality of substantially horizontal rows of bricks, the bricks in said rows having front surfaces which are substantially uniformly spaced forwardly from a substantially vertical subwall by a predetermined gauge distance, said guide assembly comprising an elongated guide member having an elongated substantially straight longitudinally extending guide face theron, an elongated spacer element having a terminal end a C-clamp secured in clamping engagement on said guide member and means adjustably securing said spacer element to said C-clamp so that said terminal end is adjustably spaced outwardly from said guide face by said gauge distance, whereby when said guide member is positioned in a substantially vertical disposition with said guide face in engagement with the front surface of a bottom row of bricks in said brick wall and said terminal end in engagement with said subwall at a point which is spaced upwardly from said bottom row, said guide face defines a guide for positioning the front surfaces of the remaining rows of bricks in said brick wall.

2. In the adjustable guide assembly of claim 1, said guide member further characterized as a carpenter's level.

3. In the adjustable guide assembly of claim 1, said carpenter's level having an aperture therethrough adjacent one end thereof for hanging said level, said C-clamp being secured in clamping engagement in said aperture.

4. In the adjustable guide assembly of claim 1, said spacer element being disposed in substantially parallel relation to the main clamping axis of said C-clamp.

5. In the adjustable guide assembly of claim 4, said clamp means further comprising an internally threaded sleeve secured to said C-clamp, said spacer element being threaded and being received in threaded engagement in said sleeve.

6. An adjustable gauge operable in combination with an elongated guide member having a longitudinally extending substantially flat guide face thereon for constructing a brick wall so that the front surface of said brick wall is substantially uniformly spaced forwardly from a subwall by a predetermined gauge distance comprising an elongated spacer element having a terminal end, a C-clamp securable in clamping engagement on said guide member and means adjustably securing said spacer element to said guide member so that said terminal end is adjustably spaced outwardly from said guide face by said gauge distance.

7. In the adjustable gauge of claim 6, said clamp means further comprising an internally threaded sleeve secured to said C-clamp, said spacer element being threaded and being received in threaded engagement in said sleeve.

8. In the adjustable gauge of claim 7, said spacer element being substantially parallel to the main clamping axis of said C-clamp.

9. A method of constructing a brick wall of a type including a plurality of substantially horizontal rows of bricks, wherein the front surfaces of said bricks are substantially uniformly spaced forwardly from a substantially vertical subwall by a predetermined gauge distance comprising the steps of laying a substantially horizontal bottom row of bricks so that the front surface of said bottom row is spaced forwardly from said subwall by said gauge distance; positioning a guide assembly so that it is in engagement with the front surface of said bottom row of bricks and also with the front surface of said subwall, said guide assembly including an elongated guide member having an elongated substantially straight longitudinally extending guide face thereon, an elongated spacer element having a terminal end and a clamp securing said gauge element to said guide member so that said terminal end is spaced outwardly from said guide face by said gauge distance, said guide assembly being positioned so that said guide face is in engagement with the front surface of said bottom row of bricks and so that the terminal end of said spacer element is in engagement with said subwall at a point which is spaced upwardly from said bottom row of bricks, and laying an additional row of bricks on said bottom row of bricks so that the front surface of said additional row of bricks is in engagement with said guide face.

10. An adjustable guide assembly for use in constructing a brick wall of a type including a plurality of substantially horizontal rows of bricks, the bricks in said rows having front surfaces which are substantially uniformly spaced forwardly from a substantially vertical subwall by a predetermined gauge distance, said guide assembly comprising an elongated guide member having an elongated substantially straight longitudinally extending guide face thereon, an elongated spacer element having a terminal end and clamp means for adjustably securing said spacer element to said guide member so that said terminal end is adjustably spaced outwardly from said guide face by said gauge distance, said clamp means comprising a frame portion including a pair of spaced clamp arms, a clamp element and means adjustably securing said clamp element to one of said clamp arms so that said clamp element is adjustably moveable toward and away from the other one of said clamp arms, said clamp means being adjustably securable to said guide member by clamping said guide member between said clamp element and said other one of said clamp arms, whereby when said member is positioned in a substantially vertical disposition with said guide face in engagement with the front surface of a bottom row of bricks in said brick wall and said terminal end in engagement with said subwall at a point which is spaced upwardly from said bottom row, said guide face defines a guide for positioning the front surfaces of the remaining rows of bricks in said brick wall.

11. An adjustable gauge operable in combination with an elongated guide member having a longitudinally extending substantially flat guide face thereon for constructing a brick wall so that the front surface of said brick wall is substantially uniformly spaced forwardly from a subwall by a predetermined gauge distance comprising an elongated spacer element having a terminal end and clamp means for adjustably securing said spacer element to said guide member so that said terminal end is adjustably spaced outwardly from said guide face by said gauge distance, said clamp means comprising a frame portion including a pair of spaced clamp arms, a clamp element and means adjustably securing said clamp element to one of said clamp arms so that said clamp element is adjustably moveable toward and away from the other one of said clamp arms, said clamp means being adjustably securable to said guide member by clamping said guide member between said clamp element and said other one of said clamp arms.

* * * * *